United States Patent [19]

Ross

[11] Patent Number: 4,585,412

[45] Date of Patent: Apr. 29, 1986

[54] INGOT PUSHER FURNACE

[75] Inventor: Robert H. Ross, Meadville, Pa.

[73] Assignee: Seco/Warwick Corporation, Meadville, Pa.

[21] Appl. No.: 770,438

[22] Filed: Aug. 29, 1985

Related U.S. Application Data

[63] Continuation-in-part of Ser. No. 585,324, Mar. 1, 1984, Pat. No. 4,540,363.

[51] Int. Cl.[4] ..... F27B 9/00; F27D 3/04

[52] U.S. Cl. ..... 432/148; 432/126; 432/144; 432/145

[58] Field of Search ..... 432/126, 144, 145, 146, 432/148, 199, 234

[56] References Cited

U.S. PATENT DOCUMENTS 3,620,520 11/1971 Ross et al. ..... 432/48

4,444,558 4/1984 Kinto ..... 432/146

4,540,363 9/1985 Ross et al. ..... 432/148

*Primary Examiner*—John J. Camby

*Attorney, Agent, or Firm*—Davis Chin

[57] ABSTRACT

An ingot pusher furnace includes a horizontal baffle assembly suspended from a frame member located above a furnace top wall. The baffle assembly includes of a center portion and a pair of first and second upwardly sloping end portions connected to the center portion. The center portion is positioned substantially parallel to an upper surface of a center portion of the ingot. A first upper horizontal baffle is connected by a first gusset to the first sloping end portion. The first upper baffle is positioned substantially parallel to and above a first end portion of the ingot. A second upper horizontal baffle is connected by a second gusset to the second sloping end portion. The second upper baffle is positioned substantially parallel to and above a second end portion of the ingot.

14 Claims, 4 Drawing Figures

INGOT PUSHER FURNACE

CROSS-REFERENCES TO RELATED APPLICATIONS

This application is a continuation-in-part of co-pending application Ser. No. 585,324, filed on Mar. 1, 1984, now U.S. Pat. No. 4,540,363, and entitled "Ingot Pusher Furnace".

BACKGROUND OF THE INVENTION

The instant invention relates to an improved ingot pusher furnace for heating a work load consisting of a plurality of aluminium ingots or billets prior to rolling the ingots or billets in a rolling mill.

It is well known for one to use a furnace to effect heating of aluminum ingots, as is disclosed in U.S. Pat. No. 3,620,520 to Ross et. al. for FURNACE HEATNG CONTROL SYSTEM, which is assigned to the assignee of the instant application. It is also well known to provide fans within such a heating furnace in order to circulate the heating medium within the furnance to effect better heat transfer with the ingots to be heated.

However, as the demand for aluminum has continued to increase, there has been a need for larger and larger aluminum ingots to be heated. It may be appreciated that as the linear size of the ingots increases, the volume of metal contained therein increases as a cubic function thereof, while the area across which heat is transferred to the ingot only increases as the square thereof, This leads to a problem that as the ingot becomes very large, typically thirty feet long, six feet wide, and two feet thick. the prior art methods of heating the ingots are inadequate due to the fact that the outer portions of the ingot are overheated and often have a higher temperature than the center portions thereof thereby causing nonuniformities in the subsequent rolling of the ingot.

In addition, due to these heat transfer problems, it is difficult to bring the ingots to uniform rolling temperature rapidly and efficiently within the furnace. As each ingot is loaded into the furnace a large quantity of heat escapes from the furnace through the open door. A second larger quantity of heat is absorbed by the relatively cold ingot. All of these conditions have a tendency to prevent the ingots from being uniformly heated.

What is needed, then, is an apparatus for improving the heat transfer characteristics of an aluminum homogenizing furnace or ingot pusher furnace so that the relatively large aluminum ingots in use today can be heated efficiently and uniformly.

SUMMARY OF THE INVENTION

An improved ingot pusher furnace for heating aluminum ingots is disclosed herein. The ingot pusher furnace comprises a base adapted to be supported above a supporting surface by a plurality of I-beams. The base includes an interior floor section having a pair of elongated rail wells formed therein which receive slidingly a plurality of tapered shoes for carrying the aluminum ingots. The elongated rail wells are divided by a raised center section and have a pair of sloping faces formed in the floor adjacent thereto in order to provide more efficient heating of the aluminum ingots. The tapered shoes and ramped rail wells provide a streamlined contour for the floor of the ingot pusher furnace which promotes uniform heating of the aluminum ingots.

A pair of vertical walls is connected to the base and a top wall or roof section is connected to the vertical walls. The base, the vertical side walls and the top wall define a heating enclosure within which the ingots are heated.

A plurality of gas burners, which are suspended from the top wall, inject heated combustion products which comprise a hot gaseous medium, into the heating enclosure. A plurality of fans are connected to the side walls and extend within the enclosure to circulate the hot gaseous medium in order to provide better heating for the aluminum ingots. A baffle assembly, having a fixed baffle support plate, is suspended from the top wall and also carries a portion of a fan shroud spaced in proximity with a plurality of fan blades. The baffle assembly includes a pair of end panels and a center panel in connection therewith. The center panel is oriented substantially parallel to the top wall of the enclosures. The end panels each have one end which is movable with the center panel in the vertical direction to accommodate various sizes of aluminum ingots. The outer ends of each of the end panels are connected to pivots so that as the center is moved vertically, the outer panels, while partially movable therewith, together with a top of the ingot to be treated, define a venturi with a section of maximum fluid velocity located at the center of the ingot thereby providing a uniform rate of temperature increase and heating across the entire ingot. The ends of the furnace enclosure are defined by a pair of vestibules, each of which include an inner door and an outer door, in order to minimize heat loss during loading and unloading of the ingots.

A principal object of the present invention is to provide a heating furnace having a movable baffle assembly which is adapted to provide uniform and rapid heating for very large aluminum ingots.

Another object of the instant invention is to provide an ingot pusher furnace having a smoothly tapering bottom adjacent to the ingot carrying shoes in order to provide streamline gas flow and uniform heat transfer across the bottom of the ingot.

It is another object of the instant invention to provide an improved ingot pusher furnace having a baffle assembly in combination with a fan for providing highly uniform heating of aluminum ingots.

It is still another object of the present invention to provide an ingot pusher furnace having a baffle assembly and upper horizontal baffles connected to the ends thereof to produce an increased gas velocity from the end of the ingot to the center of the ingot so as to provide uniform heat transfer throughout the ingot.

It is yet still another object of the present invention to provide an ingot pusher furnace which includes lower fixed horizontal baffles supported underneath end portions of ingot so as to allow the heated gases medium to pass to the center of the ingot which produces more uniform heat transfer throughout the ingot.

Other objects and uses of the present invention will become obvious to one skilled in the art upon a perusal of the following specification and claims in light of the accompanying drawings.

DESCRIPTION OF THE PREFERRED EMBODIMENTS

Figure 1:
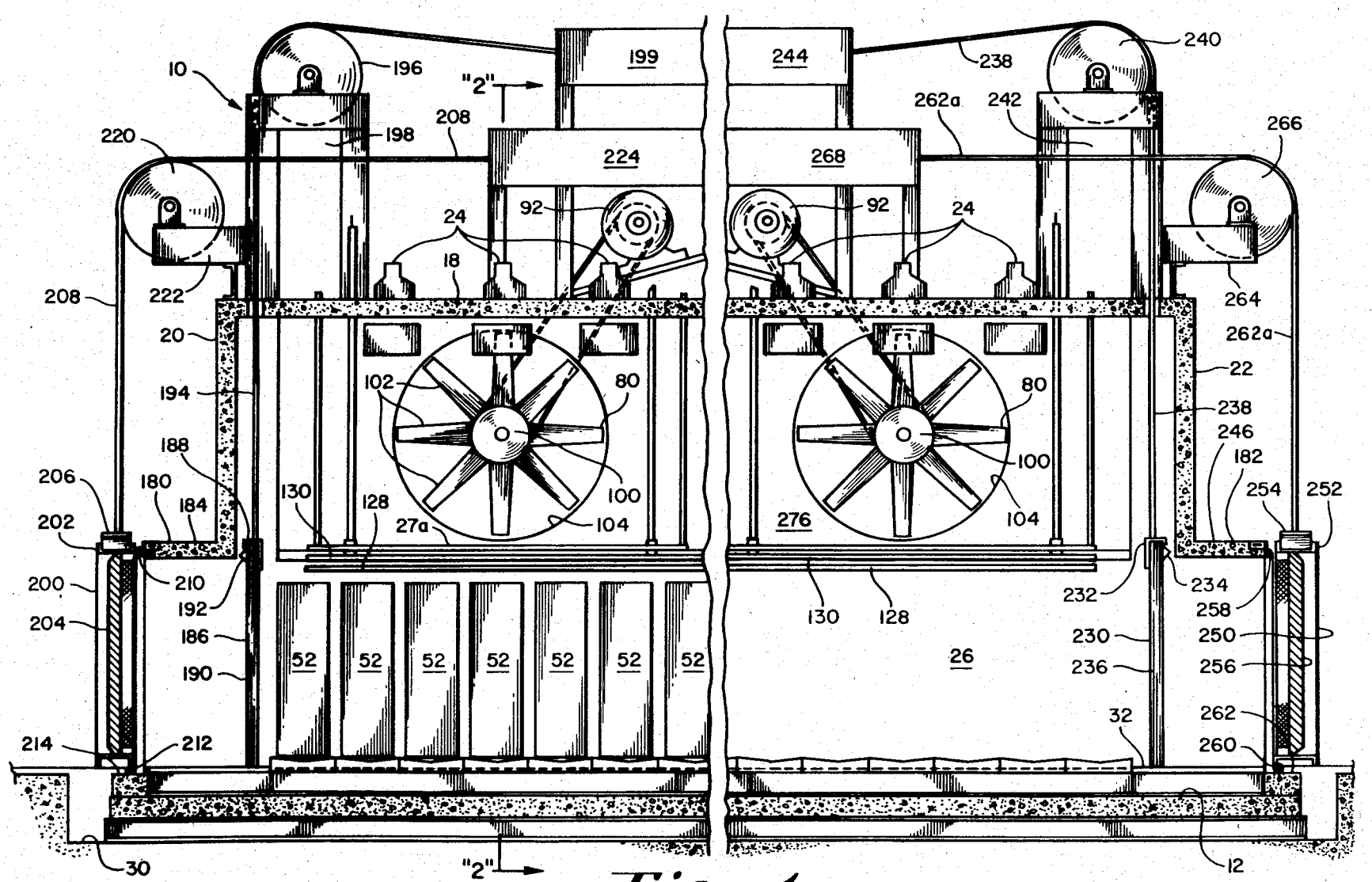
FIG. 1 is a partial section taken lengthwise of the furnace with portions thereof removed, showing details of the ingot pusher furnace embodying the present invention.

Referring now to the drawings especially to FIG. 1, an improved ingot pusher furnace generally indicated by numeral 10, and embodying the present invention is shown therein. The improved ingot pusher furnace includes a base 12, a pair of side walls respectively numbered 14 and 16 which are connected to the base 12, a top wall 18 connected to the side walls 14 and 16, an inlet end wall 20 connected to the base 12, the side walls 14 and 16 and the top wall 18 and an outlet end wall 22 connected to the base 12, the side walls 14 and 16 and the top wall 18. A plurality of conventional gas burners 24 are positioned in the top wall 18 and deliver a hot gaseous medium to an enclosure 26 defined by top 18, side walls 14 and 16, base 12, inlet end wall 20 and outlet end wall 22. In alternative embodiments of the ingot pusher furnace 10 radiant tube gas fired heaters or electric heaters may be employed to heat the enclosure 26. The enclosure 26 is divided into a plurality of heating zones respectively numbered 27*a* and 27*b*.

Figure 2:
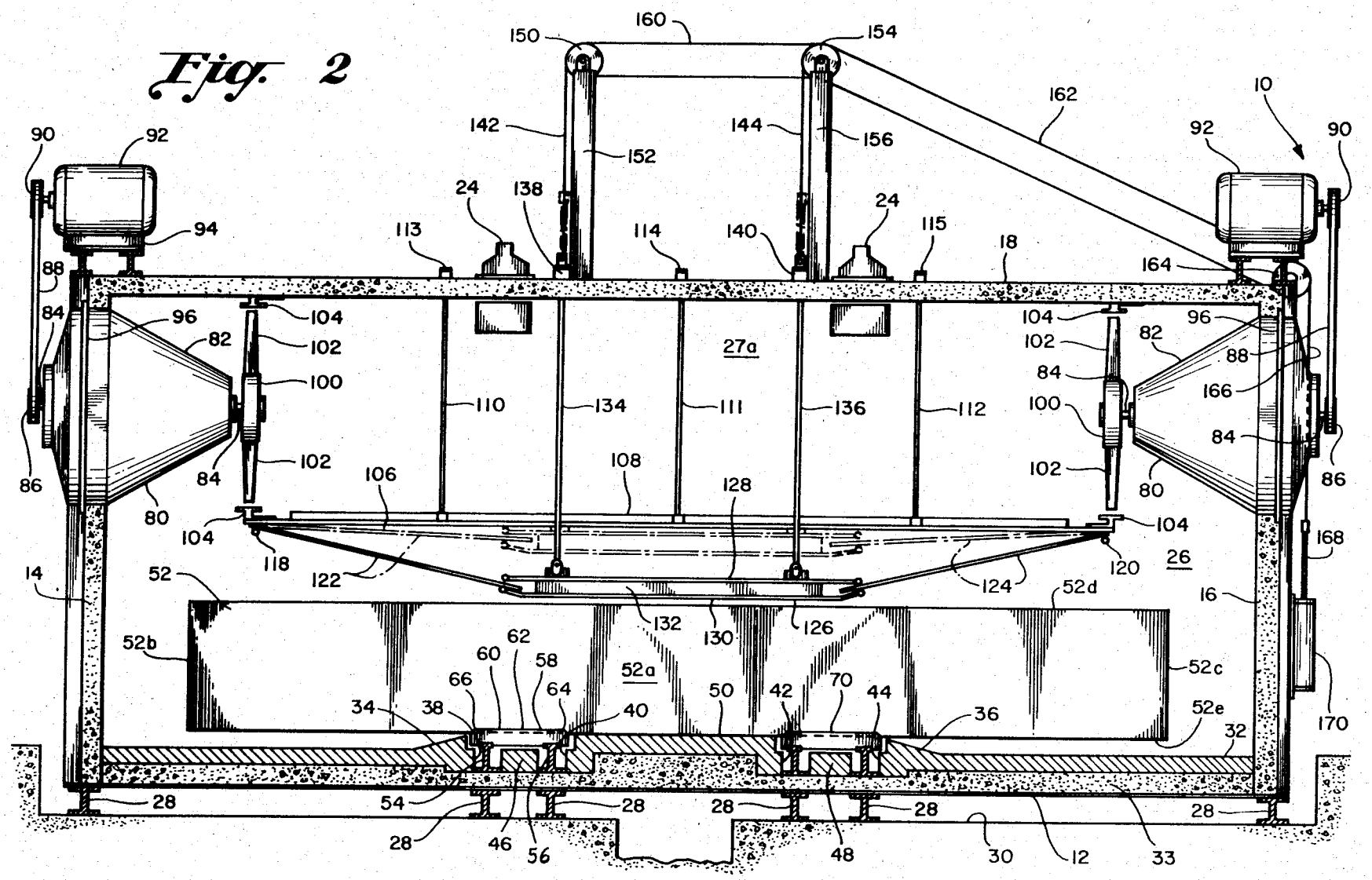
FIG. 2 is a sectional view, taken generally along line 2—2 of FIG. 1, showing details of a pair of opposed fans, a movable baffle assembly and a plurality of ingot carrying shoes of said improved ingot pusher furnace.

Referring now especially to FIG. 2, it can be seen that the base 12 is supported on a plurality of I-beams 28 which rest on a surface 30. The base 12 includes a floor 32 comprised of insulation and supported by an outer layer 33. The floor 32 extends into a pair of ramp-like tampering sections 34 and 36 which are immediately adjacent a plurality of rail wells 38, 40, 42 and 44 formed in the floor 32. The rail wells 38 and 40 are partially defined and separated by a center strip 46. The rail wells 42 and 44 are partially defined and separated by a center strip 48. It may be appeciated that immediately beneath the rail wells 38 and 40 and the rail wells 42 and 44 the outer layer 33 is somewhat less thick than it is at other locations. Between the rail wells 40 and 42 is a center floor section 50 which is substantially flush with the topmost portion ramps 34 and 36 for reasons which will become apparent hereinafter. The rail wells 38, 40, 42 and 44 are formed in the floor 32 of the base 12 in order to facilitate the support and movement of a plurality of aluminum ingots 52 to be heated within the enclosure 26. The ingots 52 are substantially rectangular and have a center portion 52*a*, an end portion 52*b*, a second end portion 52*c*, a top portion 52*d* and a bottom portion 52*e*.

The rail wells 38 and 40 receive respective rails 54 and 56 therein. Rails 54 and 56 comprise a portion of a shoe assembly 58 having an ingot receiving cross piece 60 with a top face 62 terminating in a pair of rounded shoulders 64 and 66 which effect a streamlined contour together with one of the floor ramps and raised floor surface 50. Also shown in FIG. 2 is an identical shoe assembly 70 in the rail wells 42, 44 having identical rails 54, 56 cross pieces 60 and top faces 62 as the shoe assembly 58. It may be appeciated that when the heated gaseous medium is moving within the enclosure 26 the ramp surfaces 34 and 36, together with the rounded shoulders 64 and 66 of the shoe assemblies 58 and 70, provide a very streamlined surface for the gaseous medium and help to provide better heat transfer between the bottom portion 52*e* of each of the ingots 52 and the circulating gaseous medium, thereby promoting more uniform heat transfer and temperature throughout the aluminum ingots 52.

In order to better circulate the heated gaseous medium a plurality of fans 80 are provided. The fans are identical, each of them including a pyramidal housing 82 which receives a journaled drive shaft 84. The drive shaft 84 extends out of the pyramidal housing 82 and is connected to a pulley 86. The pulley 86 is driven by a belt 88 which is frictionally engaging a pulley 90 driven by an electric motor 92 supported on a holder 94 on the top wall 18. The pyramidal housing 82 includes a sealing ring 96 surrounding it to prevent the hot gaseous medium from escaping from the furnace. The drive shaft 84 is drivingly connected to a hub 100 which has connected thereto a plurality of fan blades 102 which when rotated move the hot gaseous medium throughout the enclosure 26. The fan blades 102 are in spaced proximity with a shroud 104, a portion of which is supported from a baffle assembly 106 which is supported by the top wall 18. Although in the embodiment disclosed in FIGS. 1 and 2 a pair of opposed fans 80 is shown in each heating zone, in other embodiments of the instant invention only a single fan would be employed.

The baffle assembly 106 includes a horizontally oriented baffle supported plate 108 supported by a plurality of hanger rods respectively numbere 110, 111 and 112 which are connected by a plurality of suitable fasteners respectively numbered 113, 114, and 115 to the top wall 18. The support plate 108 carries a first pivot assembly 118 at one of its ends and a second pivot assembly 120 at the other of its ends. A baffle end panel 122 is pivotally connected to pivot 118. A baffle end panel 122 is pivotally connected to pivot 118. A baffle end panel 124 is pivotally connected to pivot 120 at one of its ends. At the other end of the end panel 122 and the other end of the end panel 124 a baffle center assembly 126, including a top plate 128, a bottom plate 130 and a spacer 132, receives the end panel 122 between the top plate 128 and the bottom plate 130 and receives the end panel 124 between the top plate 128 and the bottom plate 130. It may be appreciated that the ends of the end panel 122 and 124, since they are interfitted between the two plates, are free to slide therebetween as the center assembly 126 is moved up and down by a pair of movable support rods 134 and 136 which are supportingly connected to the top plate 128 and are received by a pair of sleeves respectively numbered 138 and 140 which are mounted on the top wall 18.

The support rod 134 is connected to a chain 142. The support rod 136 is connected to a chain 144. Chain 142 is in engagement with a pulley 150 rotatably supported by a pulley support column 152. The chain 144 is in engagement with a pulley 154 supported by a pulley support column 156. The pulley support columns 152 and 154 are mounted on the top wall 18. The pulleys 150 and 156 are joined by a chain 160. The pulley 154 is driven by a chain 162, which is in driving engagement with a pulley 164 mounted near a corner at which the top wall 18 and the side wall 16 are connected together. The pulley 164 is, in turn, driven by a chain 166 which is connected to an arm in driving connection with a hydraulic cylinder 170 mounted on side wall 16, as may best be seen in FIG. 2.

Thus, the height of the baffle center assembly 126 is controlled by the hydraulic cylinder 170. This is particularly important when ingots of varying size are to be heated. It may be appreciated that when an ingot 52 is within the furnace enclosure 26 the fans 80 are activated to circulate the gaseous medium. However, due to the fact that the ingots 52 are often quite large, the center portions 52*a* of the ingots 52 are often likely not to be heated as rapidly as the end portions 52*b* and 52*c*. In order to provide uniform heating to the entire ingot 52, the baffle assembly 106 is positioned so that the center 126 is positioned closely spaced proxmity with the ingot 52 and so that the end panels 122 and 124 slope down toward the center 52*a* of the ingot 52. Thus, as the gaseous medium flows between the top 52*d* of the ingot 52 and the baffle assembly 106, the gas velocity increases as the medium flows under the end panel 122 approaching baffle center assembly 126 and is at its maximum under the center assembly 126. The gas velocity drops as the medium flows under the end panel 124. Thus, maximum heat transfer is provided due to the highest gas velocity immediately under center panel 126, at the center portion 52*a* of the ingot 52, which is usually the slowest portion of the ingot 52 to heat up. The baffle assemby 106 also tends to concentrate all of the heated gas into contact with the center 52*a* for maximum heat transfer in the portion of the ingot which requires the most heat. Since the smooth taper of the end panels 122 and 124 effects a linear heating function, the ingots 52 is heated uniformly across its length and thereby experiences a substantially uniform heating rate and temperature uniformity throughout.

The dotted line showing of the baffle assembly 106 in FIG. 2 illustrates the manner in which the baffle center assembly 126 amy be adjusted to accommodate a larger ingot 52. It may similarly be adjusted downwardly from the solid line showing in FIG. 2 to accommodate a smaller ingot 52.

In order to provide better temperature isolation for the enclosure 26 of the ingot pusher furnace 10, an inlet vestibule 180 is connected to the inlet end wall 20 and an outlet vestibule 182 is connected to outlet end wall 22. The inlet vestiblule 180 includes a vestibule wall section 184 and an internal door 186. The internal door 186 has a frame 188 and an insulating slab 190 mounted therein. A seal 192 is connected to the frame 188. The internal door 186 is suspended from a chain 194 connected to the door frame 188. The rod 194 is engaged by a pulley 196 rotatably mounted upon a pulley support column 198. The pulley support column 198 is mounted on the top wall 18. The rod 194 is connected to a first hydraulic actuating means 199 such as a hydraulic cylinder.

When the first hydraulic means 199 is actuated, tension is placed on the chain 194 and the internal door 186 is raised. At the time, however, that the internal door 186 is raised, an inlet outer door 200 remains closed. The outer door 200 includes a frame 202 and a center insulating slab 204 mounted therein. A header 206 is connected to the door frame 202 and receives a chain 208 for support therefrom. The door insulating slab 204 terminates at a seal 210 and the door frame 202 has a bottom seal 212 adapted to engage a floor 214 of the inlet vestibule 180. The chain 208 is received by a pulley 220 which is mounted on a pulley support column 222 mounted from the top wall 18. The chain 208 is connected to a second hydraulic means 224 such as a hydraulic cylinder, which, when activated, places tension on chain 208 and raises the outer inlet door 200. When an ingot 52 is to be introduces into the furnace 10, the second hydraulic means 224 is initially activated, raising the outer inlet door 200, and the ingot 52 is placed within the inlet vestibule 180. The second hydraulic means 224 is then de-activated, allowing the outer inlet door 200 to close and the first hydraulic means 199 is activated, opening the inner inlet door 186 and allowing the ingot 52 to be pushed into the enclosure 26 by a hydraulic pusher, not shown in the drawings, but which is conventional in the art. Each shoe assembly 58 abuttingly engages the shoe assembly 58 in front of it so that the hydraulic pusher supplies a motive force to all of the shoe assemblies 58 in the ingot pusher furnace 10. In this manner the heat does not rapidly flow out of the furnace 10 as it is being loaded.

The outlet vestibule 182 is adapted to solve similar heat loss problems when the ingots 52 are leaving the ingot pusher furnace 10. In addition, since the ingots 52 leaving the ingot pusher furnace 10 should have a uniform temperature throughout their volume, the outlet vestibule 182 prevents large amount of cold air from rushing into the enclosure 26 when an end ingot 52 is discharged. Such influx of cold air has a tendency to upset the temperature uniformity of the next ingot 52 to be discharged, which can lead to nonuniformities in the subsequent ingot rolling process. An interior outlet door 230 having a frame 232, a seal 234 connected to the frame 232 and an insulating slab 236 mounted on the door frame 232 is connected to a lift chain 238, which is received by a pulley 240. The pulley 240 is rotatably mounted upon a pulley support column 242 mounted on the top wall 18. The lift chain 238 is received by a third hydraulic actuating means 244 mounted on the top wall 18. The door seal 234 is adapted to sealingly engage a top wall 246 of the outlet vestibule 182.

An outer outlet door 250 having a frame 252, a chain 262*a* connected thereto and an insulating slab 256 mounted thereon, is mounted at an exterior portion of the outlet vestibule 182. A vestibule seal 258 sealingly engages a vestibule floor piece 262. A lift chain 262*a* is connected to the chain connector 254 to provide lifting force to the outer outlet door 250. The lift chain 262*a* passes over a pulley 266 mounted on a pulley support 264 which is connected to the top wall 18. The chain 262*a* is also conected to a fourth hydraulic means 268 mounted on the top wall 18.

When one of the ingots 52 is to be removed from the furnace 10, the third hydralic means 244 is actuated, placing tension o the chain 238 and raising the inner outlet door 230 allowing the ingot 52 to be pushed into the outlet vestibule 182. The third hydraulic means 244 is then deactivated, allowing the interior outlet door 230 to close, sealing off the vestibule from the enclosure 26. Once the outlet vestibule 182 has been sealed, the fourth hydraulic means 268 is activated, placing tension on the chain 262*a* and raising the outer outlet door 250, after which the ingot 52 may be pulled out of the furnace 10 onto a suitable carrier. The fourth hydraulic means 268 is then deactivated, allowing the outer outlet 250 to close.

It may be appreciated that the vestibule 180 and 182 provide effective thermal insulation to the enclosure 26 of the ingot pusher furnace 10.

Figure 3:
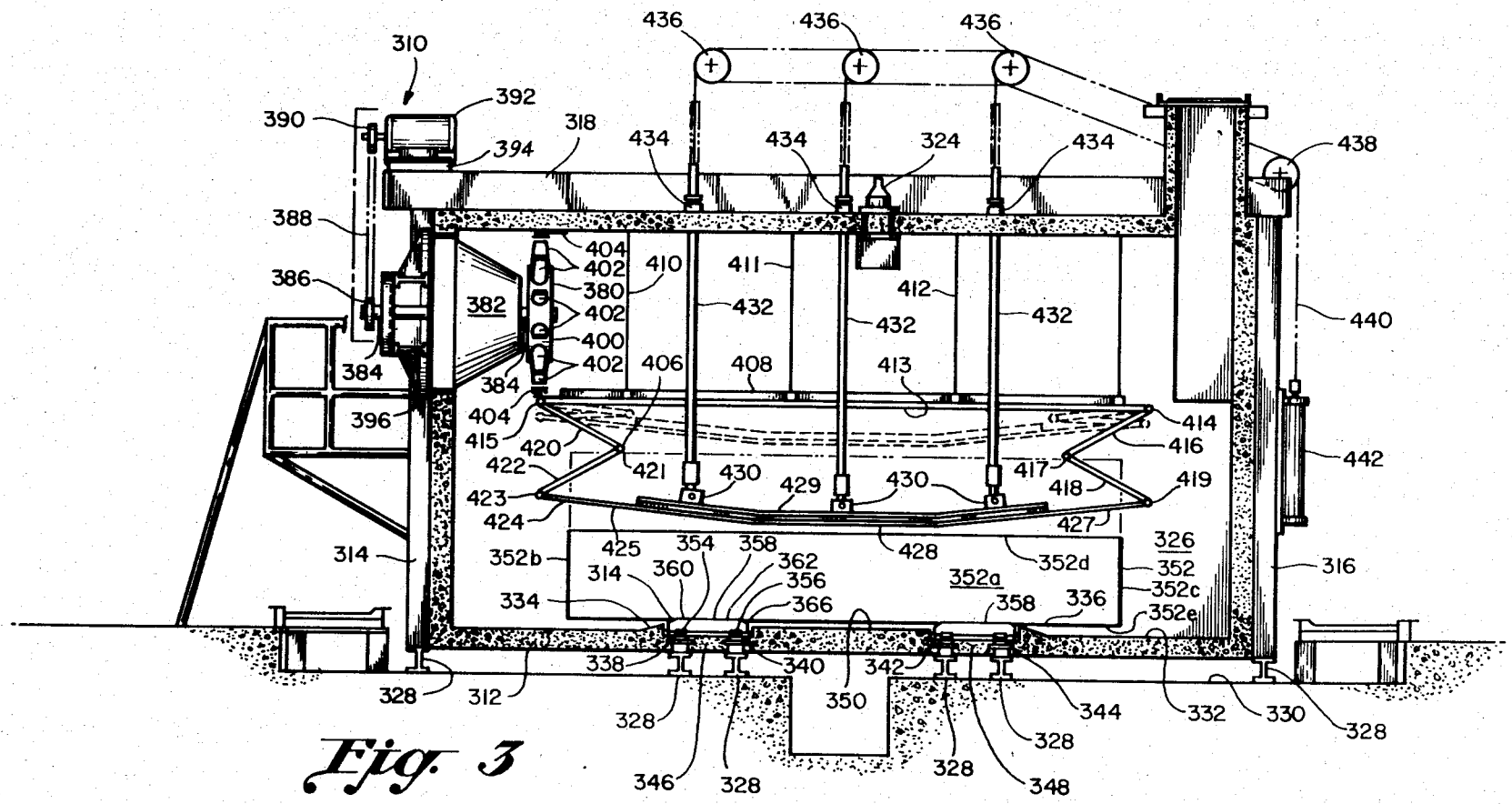
FIG. 3 is a sectional view showing details of an alternative furnace design embodying the present invention and having a pleated baffle assembly.

An alternative embodiment of the improved ingot pusher furnace 10 is shown in FIG. 3, where an improved ingot pusher furnace 310 is shown therein. The improved ingot pusher furnace 310 includes a base 312, a pair of side walls respectively numbered 314 and 316 connected to the base 312 and a top wall 318 connected to the side walls 314 and 316. A plurality of conventional gas burners, one of which is shown and identified by the numeral 324, are mounted in the top wall 318 for delivery of a heated gaseous medium to an enclosure 326 defined by the base 312, the side walls 314 and 316 and the top wall 318.

The base 312 is supported on a plurality of I-beam numbered 328. The I-beam 328 are supported on an underlying surface 330. The base 312 includes a floor 332 which extends into a pair of ramp like tapering face sections 334 and 336. Ramps 334 and 336 are immediately adjacent a plurality of rail wells numbered 338, 340, 342 and 344. The rail wells 338 and 340 are partially defined by a center floor strip 346. The rail wells 342 and 344 are partially defined by a center floor strip 348. Between the rail wells 340 and 342 is a center floor section 350, which substantially flush with the top-most portion of the ramps 334 and 336 for reasons which will become apparent hereinafter.

The rail wells 338, 340, 342 and 344 are formed in the floor 332 of the base 312 in order to facilitate the support and movement of a plurality of aluminum ingots 352. The ingots 352 each have a center portion 352*a*, a first end portion 352*b*, a second end portion 352*c*, a top portion 352*d* and a bottom portion 352*e*. The rail wells 338 and 340 receive respective rails 354 and 356 therein. The rails 354 and 356 comprise a portion of a shoe assembly 358 having an ingot receiving cross piece 360 with a top face 362 terminating in a pair of rounded shoulders 364 and 366 which effect a streamlined coutour together with the floor rampt 334 and the raised floor surface 350.

Also shown in FIG. 3 is an identical shoe assembly 358 associated with the rail wells 342, 344 and having identical surfaces and elements to shoe assembly 358 described in connection with the rail wells 338, 340. It may be appreciated that when the heated gaseous medium is moving within the enclosure the ramp 334, together with the rounded shoulders 364 and 366 on the shoe assemblies 358, provides a highly streamlined surface for the heated gaseous medium and help to provide better heat transfer between the bottom portion 352*e* of each of the ingots 352 and the circulating heated gaseous medium thereby promoting more uniform heat transfer throughout each of the aluminum ingots 352.

In order to better circulate the heated gaseous medium, a fan 380, is provided. The fan includes a pyramidal housing 382 which receives a journaled drive shaft 384. The drive shaft 384 extends out of the pyramidal housing 382 which receives a journaled drive shaft 384. The drive shaft 384 extends out of the pyramidal housing 382 and is drivingly connected to a pulley 386. The pulley 386 is driven by a chain 388 which is frictionally engaged by a pulley 390 driven by an electric motor 392 supported on a holder 394 on the top wall 318. The pyramidal housing 382 includes a sealing ring 396 surrounding it to prevent the hot gaseous medium from escaping from the enclosure 326. The drive shaft 384 is drivingly connected to a hub 400 which has connected thereto a plurality of fan blades 402 which, when rotated, move the hot gaseous medium throughout the enclosure 326. The fan blades 402 are in spaced proximity with a shroud 404, a portion of which is supported from a baffle assembly 406 which is supported by the top wall 318.

The baffle assembly 406 includes a horizontally oriented baffle support plate 408 supported by a plurality of hanger rods respectively numbered 410, 411 and 412 which are secured to the top wall 318. The support plate 408 carries an upper baffle sheet 413 from which is connected a pair of end pivots respectively numbered 414 and 415. A first pivoting end plate 416 is connected at an end to the end pivot 414 and itself has a pivot 417 connected thereto. A second plate 418 is connected to the pivot 417 and has a main pivot 419 connected thereto. An end plate 420 is pivotally connected to the pivot 415 and has a pivot 421 connected opposite the pivot 415. An end plate 422 is connected to the pivot 421 and has an end pivot 423 connected therefrom. A unitary baffle facing place 424 is connected to the pivots 423 and 419. The unitary baffle facing place 424 is constructed of a single piece and has a pair of slanted wing sections 425 and 427, respectively connected to the pivots 423 and 419, and a center portion 428 connected between the wing portions 425 and 427 and positioned substantially parallel to the ingot 352 to be treated and the top wall 318. A baffle bracket 429, having a plurality of connectors 430 connected thereto, is affixed to the baffle plate 428.

The connectors 430 are connected to a plurality of support rods 432 which pass through the top wall 318 at a plurality of couplings 434 and are connected to a pulley assembly 436 actuable through a pulley 438 mounted at a corner of the top wall 436 is, in turn, actuable through a chain 440 by a hydraulic cylinder 442, in the same fashion as the baffle means are actuable or moveable as shown in FIG. 2. One primary difference between the instant furnace 310, in particular, the baffle assembly 106 of the previous embodiment, is that baffle 406 has the fixed contour baffle plate 424 which is moveable up and down as plates 420 and 422, and 416 and 418 move in a pleated fashion to accommodate different spacings between the support plate 413 and the baffle plate 424. Thus, the contour of the venturi formed between the baffle plate 424 and the top portion 352*b* of the ingot 352 remains unchanged, allowing even greater control over the processing temperatures than is presented by the baffle assembly 106, whose contour changes as the center baffle plate is moved up and down by the baffle plate control assembly.

Figure 4:
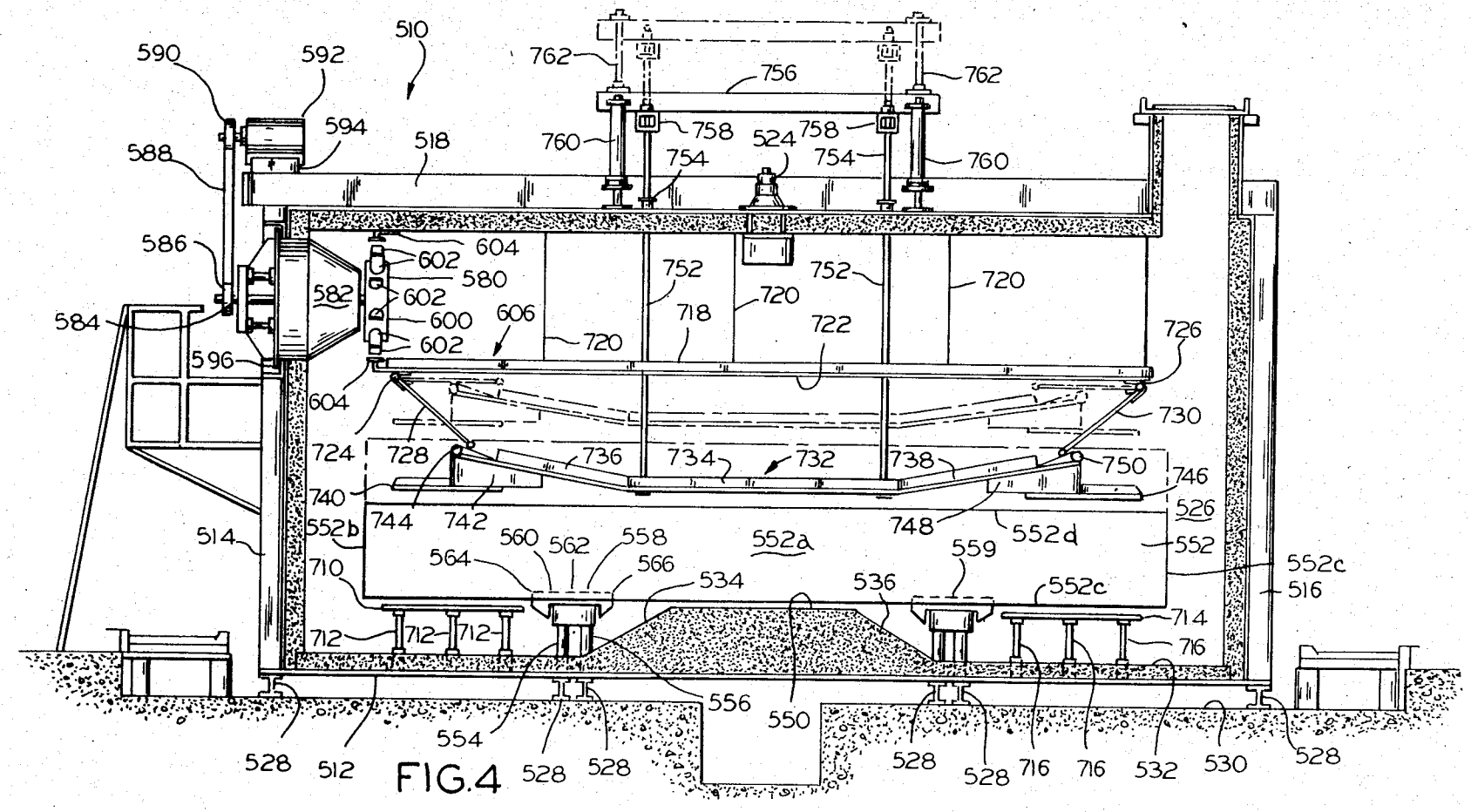
FIG. 4 is a sectional view showing another embodiment of the furnace according to the present invention and having a movable baffle assembly with horizontal wings.

Another embodiment of the improved pusher furnace 10 is illustrated in FIG. 4, wherein an improved ingot pusher furnace 510 is shown therein. The ingot pusher furnace 510 includes a base 512, a pair of side walls 514 and 516 connected to the base 512, and a top wall 518 connected to the side walls 514 and 516. A plurality of conventional gas burners, one of which is depicted and designated by reference numeral 524, are mounted in the top wall 518 for delivery of a heated gaseous medium to an enclosure 526 defined by the base 512, the side walls 514 and 516, and the top wall 518.

The base 512 is supported on a plurality of I-beams designated by reference numeral 528. The I-beams 528 are supported on an underlying surface 530. The base 512 include a floor 532 which extends into a pair of Ramp-like tapering face portions 534 and 536. A raised center floor section 550 is defined by the tapering face portions 534 and 536 which is located beneath the center of a plurality of aluminum ingot 552. Rail supports or posts 554 and 556 are formed in the floor 532 immediately adjacent the tapering face portion 534. The rail supports 554 and 556 comprise a portion of a shoe assembly 558 having an ingot receiving cross piece 560 with a top face 562 terminating in a pair of rounded shoulders 564 and 566. The shoe assembly 558 facilitate the support and movement of the aluminum ingot 552. The ingots 552 each have a center portion 552*a*, a first end portion 552*b*, a second end portion 552*c*, a top portion 552*d*, and a bottom portion 552*e*. A shoe assembly 559 is formed in the floor 532 immediately adjacent in the tapering face portion 536 and has identical surfaces and elements to the shoe assembly 558 just described.

A lower fixed horizontal baffle 710 is supported immediately adjacent to the shoe assembly 558 and underneath the first end portion 552*b* of the ingot by a plurality of columns 712 which are formed in the floor 532. A lower fixed horizontal baffle 714 is supported immediately adjacent to the shoe assembly 559 and underneath the second end portion 552*c* of the ingot by a plurality of columns 716 which are formed in the floor 532. The baffles 710 and 714 are preferable formed of a stainless steel piece. It may be appreciated that when the heated gaseous medium is moving within the enclosure 526 the horizontal baffles 710 and 714, together with the rounded shoulders 564 and 566 on the shoe assemblies 558 and 559 and the ramp-like portions 534 and 536, provides an increased gas velocity at the center of the ingots which effects better heat transfer between the center portions 552*a* of each of the ingots and the circulating heating gaseous medium, thereby promoting more uniform heat transfer throughout each of the aluminum ingots 552. As can be seen, the circulating heated gaseous medium is allowed to pass underneath the shoe assemblies and moves towards the center of the ingot.

In order to better circulate the heated gaseous medium, a fan 580 is provided. The fan includes a pyramidal housing 582 which receives a journaled drive shaft 584. The drive shaft 584 extends out of the pyramidal housing 582 and is drivingly connected to a pulley 586. The pulley 586 is driven by a belt 588 which is frictionally engaged by a pulley 590 driven by an electric motor 592 supported on a holder 594 on the top wall 518. The pyramidal housing 582 includes a sealing ring 596 surrounding it to prevent the hot gaseous medium from escaping from the enclosure 526. The drive shaft 584 is drivingly connected to a hub 600 which has connected thereto a plurality of fan blades 602 which, when rotated, moves the hot gaseous medium throughout the enclosure 526. The fan blades 602 are in spaced proximity with a shroud 604, a portion of which is supported from a fixed baffle assembly 606 which is supported by the top wall 518.

The fixed baffle assembly 606 includes a horizontally-oriented baffle support plate 718 supported by a plurality of hanger rods 720. The hanger rods 720 are secured fixedly to the top wall 518. The support plate 718 carries an upper baffle sheet 722 from which is connected a pair of end pivots 724 and 726. A first hinged section 728 is connected at one of its ends to the pivot 724. A second hinged section 730 is connected at one of its ends to the pivot 726. A movable baffle assembly 732 is arranged between the other end of the hinged section 728 and the other end of the hinged section 730. The movable baffle assembly 732 consists of a center portion 734 and a pair of upwardly sloping end portions 736 and 738 connected to the center portion 734. The center portion 734 is positioned substantially parallel to the ingot 552 to be treated and the top wall 518.

An upper horizontal baffle or wing 740 is positioned over the first end portion 552*b* of the ingot and is preferable formed of a stainless steel piece. A gusset 742 is used to connect the upper horizontal baffle 740 to the sloping end portion 736 of the baffle assembly 732. A pipe 744 is provided on the top portion of the gusset 742 to be in sliding engagement with the first hinged section 728. An upper horizontal baffle or wing 746 is positioned over the second end portion 552*c* of the ingot and is also preferable formed of a stainless steel piece. A gusset 748 is used to connect the upper horizontal baffle 746 to the sloping end portion 738 of the movable baffle assembly 732. A pipe 750 is provided on the top portion of the gaset 748 to be in sliding engagement with the second hinged section 730.

A pair of movable support rods 752 are secured at one of its ends to the center portion 734 of the movable baffle assembly 732. The support rods 752 pass through sleeves 754 which are mounted on the top wall 518. The other ends of the support rods 752 are connected to a frame member 756 by fasteners 758. The frame member 756 is raised and lowered by an actuator means formed of hydraulic cylinders 760 each having a piston rod 762 movable therein. The ends of the frame member 756 are secured to one end of the respective piston rods 762.

Accordingly, the height of the movable horizontal baffle assembly 732 as well as the horizontal baffles 740 and 746 is controlled by the hydraulic cylinders 760. It may be appreciated that when the ingot 552 is within the furnace enclosure 526 the fans 580 are activated to circulate the hot gaseous medium. As the length of the ingot increases, there will be a greater temperature difference between the ends of the ingot and the center of the ingot. In order to provide increased gas velocity from the ends of the ingot to the center of the ingot as the length of the ingot increases, the horizontal baffle assembly 732 is adjusted so that its center portions 734 is positioned in closely spaced proximity with the top of the center portion 552*a* of the ingot and so that the upper horizontal baffles 740 and 746 are positioned in closely spaced proximity over the respective first and second end portions 552*b* and 552*c* of the ingot. Thus, the gas velocity of the heated gaseous medium increases as it flows under the upper horizontal baffles approaching the center portion 734 of the movable horizontal baffle assembly and is at a maximum under the center portion, thereby providing a uniformed heat transfer throughout the ingot since the heated gaseous medium has not been chilled initially by crossing the ends of the ingot.

The dotted line showing the movable baffle assembly 732 together with the upper horizontal baffles 740 and 746 in FIG. 4 illustrates the manner in which the movable baffle assembly may be adjusted upwardly or raised to accommodate a wider ingot. It should be understood that the baffle assembly 732 may be similarly adjusted downwardly or lowered from the solid shown in FIG. 4 to accomodate a more narrow ingot. As can be seen, when the piston rods 762 are moved upwardly in the respective cylinders 760 the frame member 756 and the movable baffle assembly 732 are raised. As a result, the pipes 744 and 750 slide along the respective hinged section 728 and 730, thereby raising the corresponding upper horizontal baffles 740 and 746. The contour of the venturi formed between the movable baffle assembly 732 together with the upper horizontal baffles 740 and 746 and the top portion 552*b* of the ingot remains unchanged which permits better control over the processing temperatures. This embodiment achieves the same results which was realized by the fixed contour baffle plate 424 of FIG. 3.

While the baffle assembly 732 has been described and illustrated in FIG. 4 to be movable in the vertical condition, it should be understood that in the alternative the baffle assembly 732 may be secured fixedly to the top wall 518 so as to be unmovable in the vertical direction. As used herein, the term "length" refers to the dimension between the end portions 552*b* and 552*c* of the ingot. The term "width" refers to the dimension between the top portion 552*d* and the bottom portion 552*e* of the ingot.

It may be appreciated then that the applicants have developed a novel of ingot pusher furnace have an improved and enhanced heat transfer ability wherein heat transferred to the bottom of an aluminum ingot to be treated is promoted through the use of a streamlined floor and shoe assembly. Heat transferred to the top of the ingot is promoted through the use a novel baffle assembly having a center section with is moved most closely into proximity with the center of the ingot to provide differentially more heating or heat transfer to the center of the ingot than to its end portions.

While there has been illustrated and described a particular embodiment of the present invention, it will be appreciated that numerous changes and modifications will occur to those skilled in the art and it is intended in the appended claims to cover all those changes and modifications which fall within the true spirit and scope of the present invention.

What is claimed is:

1. An ingot pusher furnace for heating an ingot comprising:

an enclosure having a base, a plurality of vertical side walls connected to said base and a top wall;

means for heating said enclosure by heating a gaseous medium therein;

means for moving said gaseous medium within said enclosure;

a horizontal baffle assembly suspended from a frame member located above said top wall, said baffle assembly including a center portion and a pair of first and second upwardly sloping end portions connected to said center portion, said center portion being positioned substantially parallel to an upper surface of a center portion of the ingot;

a first upper horizontal baffle connected by a first gusset to the first sloping end portion, said first upper baffle being positioned substantially parallel to and above a first end portion of the ingot;

a second upper horizontal baffle connected by a second gusset to the second sloping end portion, said second upper baffle being positioned substantially parallel to and above a second end portion of the ingot; and whereby when the gaseous medium is forced between the upper surface of the ingot and the horizontal baffles its velocity is increased from the end of the ingot to the center of the ingot so as to provide uniform heat transfer throughout the ingot.

2. An ingot pusher furnace as claimed in claim 1, further comprising a pair of shoe assemblies each being positioned underneath and adjacent to the center portion of the ingot, said shoe assemblies being adapted to support the ingot to be heated.

3. An ingot pusher furnace as claimed in claim 2, further comprising a first lower fixed horizontal baffle positioned immediately adjacent one of the pair of shoe assemblies and underneath the first end portion of the ingot and a second lower fixed horizontal baffle positioned immediately adjacent the other one of the pair of shoe assemblies and underneath the second end portion of the ingot, said lower baffles allowing the gaseous medium to pass underneath the shoe assemblies and to move toward the center of the ingot.

4. An ingot pusher furnace as claimed in claim 1, wherein said first upper horizontal baffle comprises a stainless steel piece.

5. An ingot pusher furnace as claimed in claim 1, wherein said second upper horizontal baffle comprises a stainless steel piece.

6. An ingot pusher furnace as claimed in claim 3, wherein said first lower fixed horizontal baffle comprises a stainless steel piece.

7. An ingot pusher furnace as claimed in claim 3, wherein said second lower fixed horizontal baffle comprise a stainless steel piece.

8. An ingot pusher furnace as claimed in claim 1, further comprising a first hinged section having its one end pivotally attached to a support means connected to said top wall and having its other end slidably engaging with said first gusset and a second hinged section having its one end pivotally attached to the support means connected to said top wall and having its other end slidably engaging with said second gusset.

9. An ingot pusher furnace as claimed in claim 1, further comprising support members having one of its ends connected to the center portion of the baffle assembly and having its other ends connected to the frame member, said frame member being adapted to move said baffle assembly, said first upper baffle and said second upper baffle in a vertical direction so as to accomodate ingots of various sizes.

10. An ingot pusher furnace as claimed in claim 9, further comprising actuators means operatively connected to said frame member for raising and lowering of the same.

11. An ingot pusher furnace as claimed in claim 10, wherein said actuator means comprises a hydraulic cylinder and a piston rod, one end of said piston rod being connected to said frame member.

12. An ingot pusher furnace as claimed in claim 1, wherein said means for moving said gaseous medium within said enclosures comprises a fan mounted upon one of said side walls of said enclosure.

13. An ingot pusher furnace as claimed in claim 1, wherein said baffle assembly is movable in a vertical direction.

14. An ingot pusher furnace as claimed in claim 1, wherein said baffle assembly is secured fixedly to the top wall so as to be unmovable in a vertical direction.

* * * * *